United States Patent [19]

Kingston

[11] Patent Number: 4,962,508

[45] Date of Patent: Oct. 9, 1990

[54] DUAL CHANNEL INTERFERENCE CANCELLER

[75] Inventor: Samuel C. Kingston, Salt Lake City, Utah

[73] Assignee: Unisys Corporation, Blue Bell, Pa.

[21] Appl. No.: 908,831

[22] Filed: Sep. 18, 1986

[51] Int. Cl.[5] ..... H04K 1/00

[52] U.S. Cl. ..... 375/1; 380/6

[58] Field of Search ..... 375/1, 103, 106, 113, 375/120; 380/6

[56] References Cited

U.S. PATENT DOCUMENTS 4,601,005 6/1986 Kilvington ..... 375/1

4,646,173 2/1987 Kammeyer et al. ..... 375/103

*Primary Examiner*—Salvatore Cangialosi

*Attorney, Agent, or Firm*—John B. Sowell; Robert S. Bramson; Mark T. Starr

[57] ABSTRACT

In a receiving apparatus for detecting the presence or absence of periodically keyed random modulated signals, there are provided a pair of separate and distinct detection channels. One channel produces a real signal having clock line components and the other channel produces a decorrelated imaginary signal having no clock line components. The real and imaginary signals having carrier wave interference signals are processed in a Fourier transform device and a post processor to cancel out the carrier wave interference signals and to provide only a clock signal output when periodically keyed random modulated signals are being received.

7 Claims, 3 Drawing Sheets

FREQUENCY - INPUT SPECTRUM

FREQUENCY - OUTPUT - NO DELAY SPECTRUM

FREQUENCY - OUTPUT - DELAY SPECTRUM

FREQUENCY - PROCESSED SPECTRUM = A-B

DUAL CHANNEL INTERFERENCE CANCELLER

BACKGROUND OF THE INVENTION

1. Related Applications

This invention is an improvement of application Ser. No. 408,542 filed Aug. 16, 1982 by Samuel C. Kingston for a "Dual Channel Clock Recovery Circuit".

2. Field of the Invention

This invention relates to the detection of covert communication signals. More particularly, this invention relates to an improved novel circuit for detecting the presence of signals which typically are received at very low signal to interference and noise ratios.

3. Description of the Prior Art

The general class of signals to which the present invention is directed are commonly referred to as periodically keyed random modulated signals. For example, communications intelligence is often transmitted in coded form. One former way of denying data access to the enemy is to transmit the data stream in direct sequence spread spectrum format. It is extremely difficult to detect data signals embedded or encoded in such spread spectrum format because the signal-to-noise ratio is so low as to make detection difficult.

Before it is possible to attempt to decode direct sequence spread spectrum coded data signals, it is necessary to determine that such coded signals are actually being transmitted. This invention is directed to the problem of detecting that such coded signals are being transmitted and is not directed to the problem of decoding such signals.

It has been suggested that radiometers or power signal detection devices may be employed to determine if periodically keyed random modulated signals are being transmitted. When such signals are received at a receiver, it is often impossible to distinguish them from the received noise, thermal background noise, other transmitted signals and interferring emission signals. It is possible that the power level of the signals which are to be detected, do not exceed the background and interference signals mentioned above thus, it is often impossible to employ radiometers and power detection devices to detect the presence of low power periodically keyed random modulated signals.

When a radiometer is employed to detect the presence of a signal, then the threshold of a detector must be set very close to the signal levels. Changes in either the interference levels or the threshold levels will affect the sensitivity of the receiver which results in false alarms or reduced sensitivity. For example, if the threshold of a radiometer is set to detect the desired signal at minus 20db signal-to-noise ratio, then a one percent increase in interference level will cause a false alarm.

It has been suggested that since periodically keyed random modulated signals by definition change symbols at a fixed rate, it may be possible to detect a periodic repetition as a clock signal even though the data signal is not discernable.

In the above-mentioned application Ser. No. 408,542, the received periodically keyed random modulated signals were split into two separate and distinct channels, each comprising a narrow band pass filter. One of the narrow band pass filters in one of the channels was tunned to a frequency higher than the expected center frequency of the periodically keyed random modulated signals and the other narrow band pass filter was tunned to a frequency lower than the expected center intermediate frequency. The distance between centers of the narrow band pass filter frequencies was designed to be approximately the clock frequency to be detected, thus, both channels contain spectral signals indicative of the clock signal to be detected. The outputs from the narrow band pass filters were connected to a mixer to provide an output signal therefrom representative of a clock having a frequency equal to the periodically keyed random modulated signal. The output from the mixer was detected and/or analyzed for the presence of a clock signal by comparing the mixer output with a reference frequency or a reference voltage. While this apparatus and structure is extremely effective in detecting the presence or absence of periodically keyed random modulated signals, the signals being analyzed and/or compared include interference lines representative of continuous wave (C.W.) interference signals.

It would be extremely desirable to eliminate the C.W. interference signals that appear the same as clock signals and can produce false alarms or false indications of such clock signals.

SUMMARY OF THE INVENTION

It is a principal object of the present invention to provide a novel dual channel clock recovery circuit and C.W. interference cancellation circuit.

It is another principal object of the present invention to provide a novel dual channel clock recovery circuit having outputs indicative of power spectrums with a clock line component and a power spectrum without a clock line component.

It is another principal object of the present invention to provide a novel dual channel clock recovery circuit having a discrete Fourier transform device and a post processor for performing an algorithm which detects the presence or absence of clock line components in the dual channel detection outputs.

It is a general object of the present invention to provide a novel clock recovery circuit for periodically keyed random modulated signals.

It is another general object of the present invention to provide a dual channel clock recovery circuit for low signal-to-noise ratio periodically keyed random modulated signals.

It is yet another object of the present invention to provide a new and more reliable circuit for detecting the absence or presence of periodically keyed random modulated signals.

According to these and other objects of the present invention, there is provided a novel circuit for detecting the presence or absence of a periodically keyed random modulated signal which includes a power splitter adapted to supply two separate and distinct channels with the source of periodically keyed random modulated signals. The separate channels contain narrow band pass filters. One filter is tunned to a frequency higher than the expected center frequency of the periodically keyed random modulated signals and the other band pass filter is tunned to a frequency lower than the expected center frequency. The distance between centers of the narrow band pass filters is approximately the clock frequency to be detected. The output from the narrow band pass filters is cross-connected to a pair of mixers wherein one of the filtered signals is delayed before being applied to the mixer to effectively decorrelate the periodically keyed random modulated signal, thereby, eliminating its clock line component. The output from the two mixers is digitized and then Fourier transformed from a time to a frequency spectrum so that the frequency spectrum output therefrom can be digitally analyzed to detect the presence or absence of a clock line component in the spectrum without having to detect C.W. components.

DESCRIPTION OF THE PREFERRED EMBODIMENT

Figure 1:
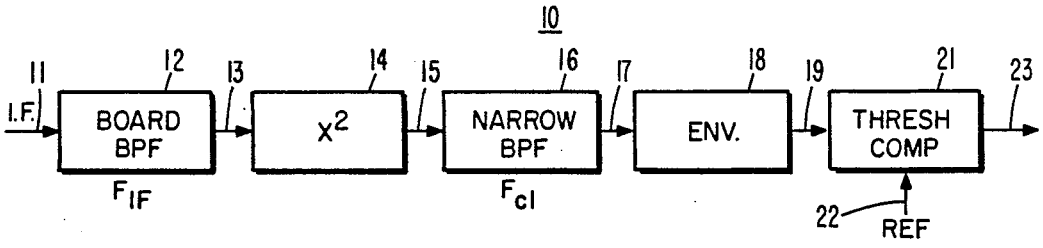
FIGURE 1 (PRIOR ART)
FIG. 1 is a block diagram showing a prior art single channel circuit for recovering the clock signal from a randomly modulated intermediate frequency signal.

Refer now to FIG. 1 showing a prior art single channel clock recover circuit 10. The intermediate frequency signal to be detected is shown being applied via input line 11 to a broad band pass filter 12. The output on line 13 is applied to a square law detector 14. The output from square law detector 14 on line 15 is applied to a narrow band pass filter 16 to remove the interference and noise signals close to the clock frequency spectral line. The output or tone signal from the narrow band pass filter 16 on line 17 is applied to the envelope detector 18 to provide an amplitude output signal on line 19 indicative of the tone signal being envelope detected. The amplitude signal on line 19 is applied to the threshold comparator 21 which is also supplied with a reference voltage threshold input via line 22. When the amplitude signal on input line 19 exceeds the reference voltage on line 22, the threshold comparator 21 produces an output signal on line 23 indicative of the presence of a periodically keyed random modulated signal being presented at the input line 11. It is not desirable to have to employ broad band pass filter 12 in order to detect the main lobe of the signal to be detected. When such broad band pass filters are employed, the incidence of false alarm indication increases substantially.

Figure 2:
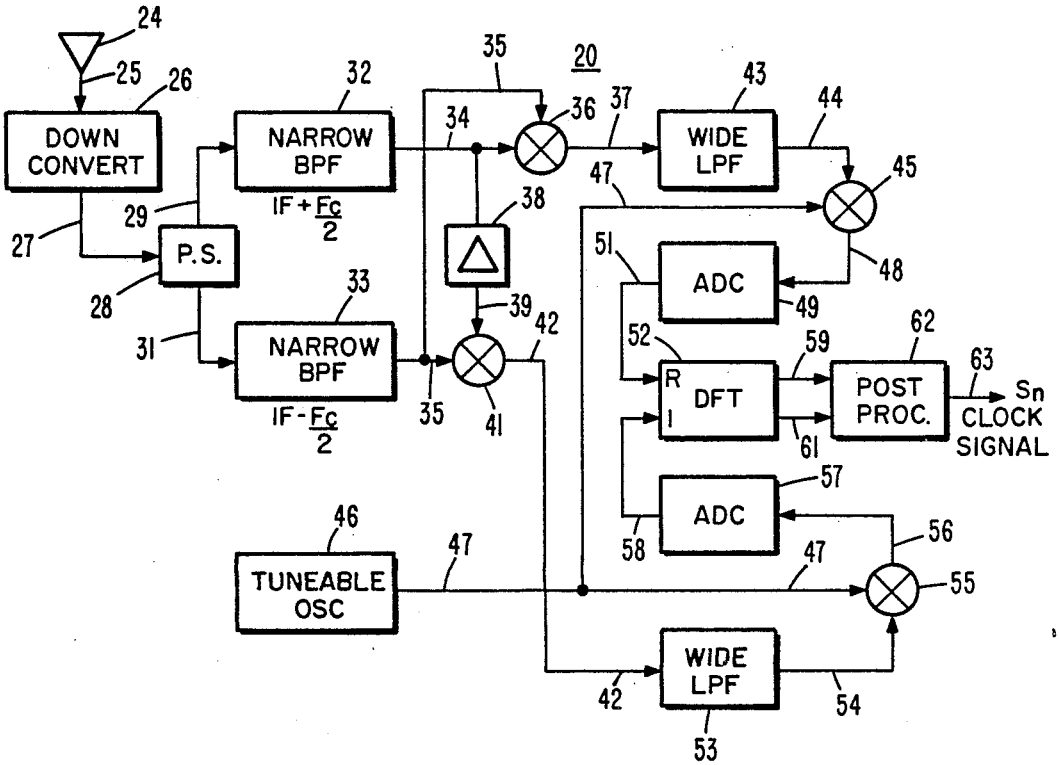
FIG. 2 is a block diagram of the preferred embodiment of the present invention dual channel interference canceller for recovering the clock signal from a randomly modulated intermediate frequency signal.

Refer now to FIG. 2 showing a block diagram of the preferred embodiment of the present invention dual channel interference canceller for recovering clock signals from periodically keyed random modulated signals. The clock recovery circuit 20 is shown having an antenna 24 connected via line 25 to a down converter 26 of the type which modulates the incoming signal to provide an intermediate frequency on line 27. The signal on line 27 is divided in power splitter 28 to provide identical signals on lines 29 and 31 which are applied to the narrow band pass filters 32 and 33. The narrow band pass filter 32 is tunned to pass the intermediate frequency plus half of the clock frequency on output line 34. The narrow band pass filter 33 is tunned to provide the intermediate frequency minus half the clock frequency on output line 35. The signals on lines 34 and 35 are applied to a first mixer 36 to produce an output on line 37 which is representative of the inherent clock frequency of the periodically keyed random modulated signal if such signal is present.

The signal on line 34 is delayed in delay 38 more than the correlation time of band pass filter 32 so that the signal on line 39 is effectively decorrelated. Thus, when the signals on lines 35 and 39 are applied to the second mixer 41, the output on line 42 does not have a clock line component if the periodically keyed phase modulated signal was present at the antenna 24. When the periodically keyed random modulated signal is not present at the input antenna 24, then the only signals present on lines 37 and 42 are the noise and interference signals. Assuming that a periodically keyed random modulated signal was present at antenna 24, then there is a clock signal component on line 37 which is applied to the wide low pass filter 43 to remove the sum frequencies on output line 44 which is applied to mixer 45. Thus, the different frequencies are on line 44 being applied to mixer 45. A tunable oscillator 46 is connected via line 47 to mixer 45 to provide an output on line 48 representative of a clock frequency which has been changed by the tunable oscillator 46. The analog signal on line 48 is applied to analog to digital converter 49 to produce a digitized version of the input signal on output line 51. The digitized signals on line 51 are applied to the real input of a discrete Fourier transform device 52.

The output from mixer 41 on line 42, as explained hereinbefore, has no clock component, however, this line has all of the C.W. interference component signals that appear on line 37. These signals are applied to wide low pass filter 53 to remove the sum components and provide the difference components on line 54 which are applied to mixer 55 along with the tunable oscillator input signal on line 47 to produce the analog difference signal components on line 56. The analog signal components on line 56 are applied to the analog to digital converter 57 to produce digitized signals of the analog input signals on line 58. The digitized signals on line 58 are applied to the imaginary input of the discrete Fourier transform device 52.

The output on line 59 from device 52 represents the real components of the transformed operation and the output on line 61 represents the imaginary components of the transformed operation. The discrete Fourier transform device 52 collects N number of samples on lines 51 and 58 and produces N number of transform samples in the form of digital magnitudes on lines 59 and 61 which are collected and stored in registers in the device 52. The registers of device 52 are periodically read by the post processor 62 that performs a mathematical computation on the digital magnitude supplied on lines 59 and 61.

The signal out ($S_n$) on output line 63 is equal to $S_n = R_n(R_{N-n}) - I_n I_{N-n})$ where $R_n$ is the $n^{th}$ real sample on line 59 in a sequence of N numbers of samples and $I_n$ is the $n^{th}$ imaginary sample on line 61 applied to the processor 62. $R_N$ and $I_N$ represent the last number of the real and imaginary samples supplied to the post processor 62 via lines 59 and 61. Thus, $R_N$ and $I_N$ represent the last sample in the group being sampled.

The computation performed by the post processor 62 produces a digital number S representation on line 63 representative of the difference in the power spectrum present on lines 37 and 42 and/or on lines 51 and 58.

Thus, the computation performed eliminates all of the C.W. interference lines in the power spectrum.

Figure 3:
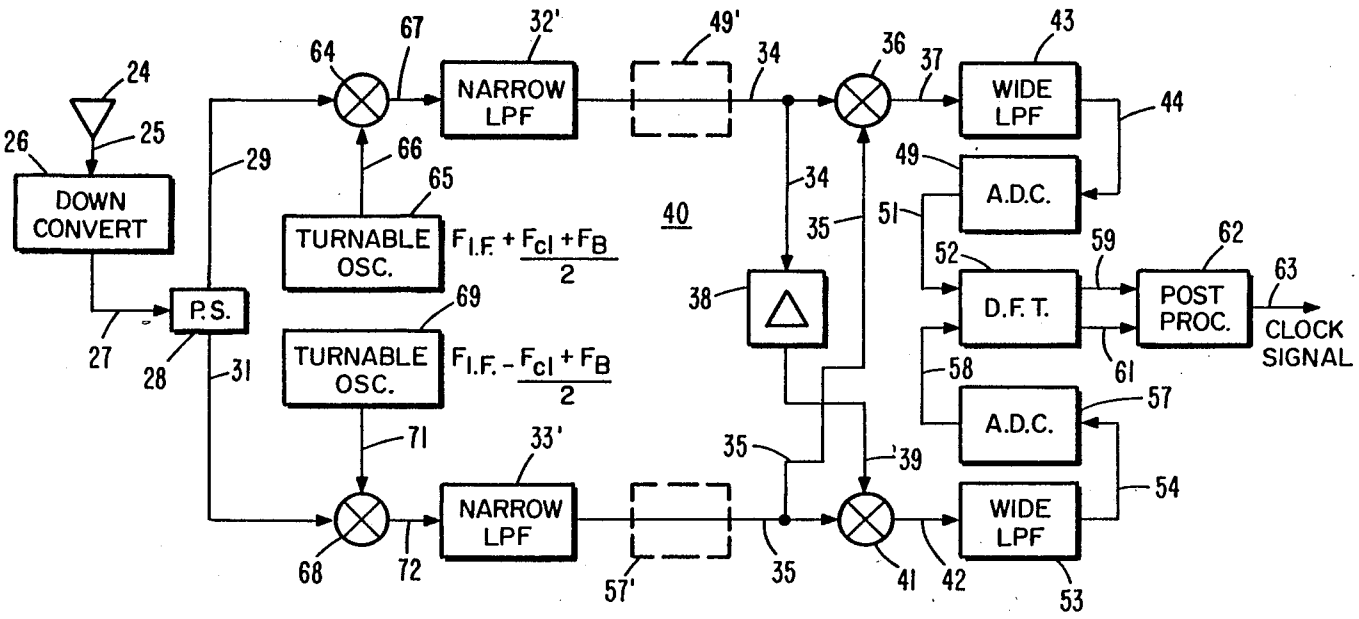
FIG. 3 is a block diagram of a simplified preferred embodiment of the novel dual channel interference canceller shown in FIG. 2.

Refer now to FIG. 3 showing a block diagram of a simplified preferred embodiment 40 of the circuit shown in FIG. 2. The FIG. 2 embodiment is to be employed where the highest amount of sensitivity is required. The FIG. 2 embodiment is a based band version which is to be employed when the narrow band pass filters 32 and 33 are replaced with narrow low pass filters 32' and 33' to provide greater flexibility in the desired range of operation. Antenna 24, down converter 26 and power splitter 28 are identical to the same elements with the same numbers explained hereinbefore with reference to FIG. 2. Similarly, the lines 34 and 35 and the remaining clock detector circuit employing numbers 34 to 63 are substantially identical to those explained hereinbefore with reference to FIG. 2.

In the FIG. 3 base band version, the signals on lines 34 and 35 are being multiplied in mixer 36 to provide a clock line component on line 37. Similarly, the signals on lines 35 and 39 are being multiplied in mixer 41 to provide a signal component not having a clock signal but having all of the C.W. interference lines on line 42. Thus, filters 43 and 53 limit the frequency of the data being applied on lines 44 and 54 to the analog to digital converters 49 and 57 so that they are capable of accommodating the input data. If the sampling rate of the analog to digital converters 49 and 57 is fast enough to accommodate the narrow low pass filter output from filters 32' and 33' on lines 34 and 35, it is possible to place the analog to digital conveters in series in the output lines 34 and 35 as shown by the phantom lines 49' and 57'. Thus, it will be understood that even though the analog to digital converters 49 and 57 are moved further upstream, a low pass filter 43 and 53 will still be required to reduce the sample rate on the input lines 51 and 58 to the discrete Fourier transform device 52.

The IF signal on line 29 is applied to a mixer 64. A tunable oscillator 65 provides a signal frequency on line 66 which is applied to the mixer 64 to provide a signal which is higher than the IF frequency signal $F_{IF}$ on line 67. The tunable oscillator preferably provides a signal which is equal to $F_{IF}+F_{CL}+F_{B/2}$ where $F_{CL}$ is the clock frequency and $F_B$ is a bias frequency which is much lower than the clock frequency and is approximately equal to the center of the spectral range being transformed by the discrete Fourier transform device 52. Similarly, the IF frequency on line 31 is applied to mixer 68 and a tunable oscillator 69 provides a signal on line 71 which is lower than the IF frequency. The frequency on line IF is approximately equal to $F_{IF}-F_{CL}+F_{B/2}$. The base band signals on lines 67 and 72 which are applied to the narrow low pass filters 32' and 33' have been substantially reduced from the IF frequencies so that narrow low pass filters may be employed in the simplified circuit. The mode of operation of the simplified clock recovery circuit 40 is substantially the same as that explained hereinbefore with regards to the clock recovery circuit 20 shown in FIG. 2. The C.W. interference signals are substantially suppressed so that the detection of the clock signal representative of the periodically keyed random modulated signal is more easily detected Refer now to FIG. 4 which is a diagram of the input signal frequency spectrum to be employed for an explanation of the operation of the narrow band pass filters employed in FIG. 2. The filter response curve 73 is representative of the output from narrow band pass filter 32' on line 34. The filter response curve 74 is representative of the output from narrow band pass filter 33' on line 35. It will be understood by examination of FIG. 4 that the narrow band pass filters of the circuit of FIG. 2 are all tunned to a frequency which is very close to the intermediate frequency 75 and that the separation of the filters 32' and 33' are separated by the clock frequency shown as $F_{CL}$. The filter response curves 73 and 74 illustrates clearly that the narrow band pass filters 32' and 33' may be operably placed within the main lobe of the input power spectrum 76. Superimposed on FIG. 4, there are shown spectral lines which are representative of narrow band interferers. The narrow band interferers 77 to 81 are representative of undesirable noise etc. signals which occur at different frequencies that are close to the intermediate frequency. It will now be explained how it is possible to eliminate these narrow band interferers employing a discrete Fourier transform device and a post processor.

Figure 4:
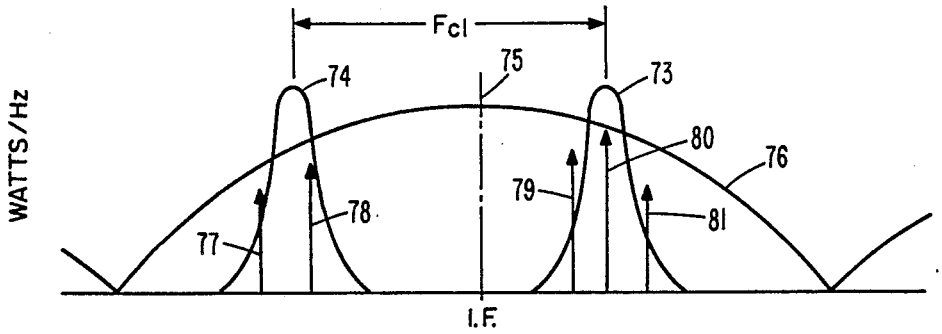
FIG. 4 is a diagram of the input signal frequency spectrum to the dual channel detection circuits of FIGS. 2 and 3.
Figure 5A:
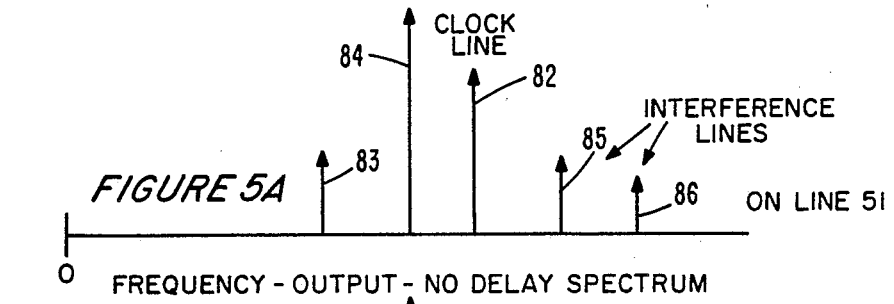
FIGS. 5A, 5B and 5C are diagrams of the output signal spectra which is transformed and processed to detect the presence of clock signals without detecting C.W. interference signals.
Figure 5B:
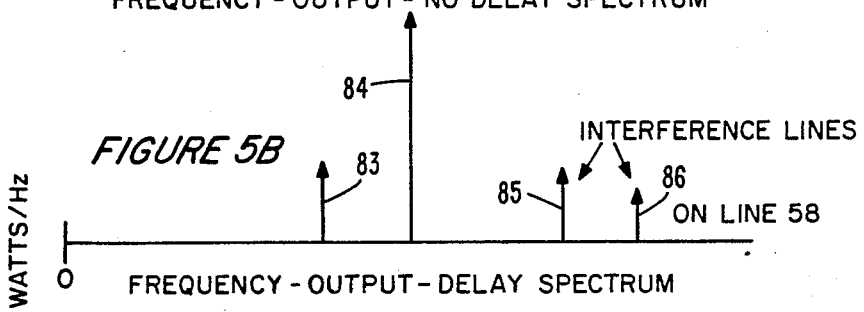
Figure 5C:
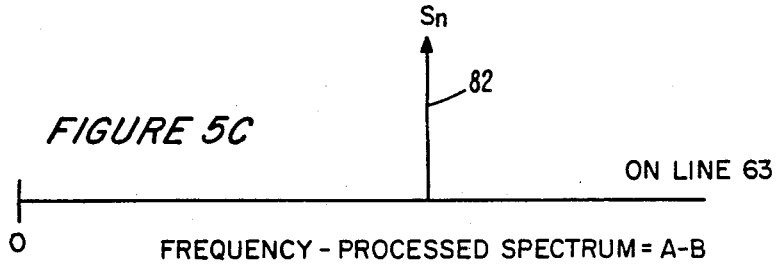

Refer now to FIGS. 5A to 5C showing interference lines which occur close to the clock frequency shown as line 82 in FIG. 5A. It will be understood that the IF frequency shown as line 75 in FIG. 4 is much lower than the clock frequency shown in FIGS. 5A to 5C and that the narrow band interferers 77 to 81 shown in FIG. 4 are multiplied in the clock recovery circuits 20 and 40 to produce interference lines 83 to 86 which occur on lines 51 and 58 as inputs to the discrete Fourier device. The interference lines of FIGS. 5A and 5B are accumulated in Fourier transform device 52 and subtracted in the post processor 62 to completely eliminate the interference lines 83 to 86' as shown in FIG. 5C, as explained hereinbefore. Since this subtraction is a digital process, the only digital magnitude signal being produced on output line 63 is the clock signal 82 as shown in FIG. 5C.

Having explained a preferred embodiment IF version of the dual channel interference canceller receiver, it will be understood that decorrelated imaginary signals are applied to a discrete Fourier transform device and a post processor so that C.W. interference signals are completely eliminated leaving a clock signal indicative of the presence of a periodically keyed random modulated signal.

I claim:

1. A circuit for detecting the presence or absence of a periodically keyed random modulated signal source containing interference signals comprising:

receiving means for receiving periodically keyed random modulated signals, means for converting said received periodically keyed random modulated signals to a pair of intermediate frequency signals having continuous wave interference signals thereon, a first dual channel detection circuit comprising a first mixer coupled to one of said intermediate frequency signals, a second dual channel detection circuit comprising a second mixer coupled to the other of said intermediate frequency signals, a delay coupled to said first dual channel detection circuit and to said second mixer, a line coupled to said second dual channel detection circuit and to said first mixer, first wide low pass filter menas coupled to the output of said first mixer to provide only the real signal component, second wide low pass filter means coupled to the output of said second mixer to provide only the imaginary signal component, a discrete Fourier transform device coupled to said real and said imaginary signal components containing carrier wave interference signals for performing spectrum analysis of said signal components and to provide real and imaginary transform data outputs, and a post processor coupled to said real and said imaginary data outputs for detecting the presence of clock signals in said received signals and cancelling out the carrier wave interference signals.

2. A circuit as set forth in claim 1 which further includes an analog to digital converter coupled between said low pass filter means and said discrete Fourier transform device.

3. A circuit as set forth in claim 1 which further includes an analog to digital converter in series between said dual channel detection circuit and the input to said first and second mixers.

4. A circuit as set forth in claim 1 wherein said dual channel detection circuit comprises first and second tunable oscillators connected respectively to first and second mixers having their outputs coupled to first and second narrow low pass filters.

5. A circuit as set forth in claim 4 which further includes a power splitter connected to said third and fourth mixers.

6. A circuit as set forth in claim 1 wherein said first and second wide low pass filter means each comprise an analog to digital converter.

7. A circuit as set forth in claim 6 which further comprises third and fourth mixers connected in series between said wide low pass filters and said analog to digital converters, and a tunable oscillator connected to said mixers.

* * * * *